US011607572B1

(12) United States Patent
Bradley

(10) Patent No.: US 11,607,572 B1
(45) Date of Patent: Mar. 21, 2023

(54) MULTI-PURPOSE JUMP FITNESS, RESISTANCE STRENGTH AND BOXING TRAINING DEVICE, SYSTEM AND METHOD

(71) Applicant: David Bradley, Larchmont, NY (US)

(72) Inventor: David Bradley, Larchmont, NY (US)

( * ) Notice: Subject to any disclaimer, the term of this patent is extended or adjusted under 35 U.S.C. 154(b) by 98 days.

(21) Appl. No.: 17/313,495

(22) Filed: May 6, 2021

(51) Int. Cl.

| | |
|---|---|
| ***A63B 5/20*** | (2006.01) |
| ***A63B 21/055*** | (2006.01) |
| ***A63B 21/00*** | (2006.01) |
| ***A63B 21/02*** | (2006.01) |

(52) U.S. Cl.
CPC ..... *A63B 5/20* (2013.01); *A63B 21/028* (2013.01); *A63B 21/0557* (2013.01); *A63B 21/4035* (2015.10); *A63B 2244/102* (2013.01)

(58) Field of Classification Search
CPC ..... A63B 5/20–205; A63B 2244/102; A63B 21/05–0557; A63B 21/028; A63B 21/4035
See application file for complete search history.

(56) References Cited

U.S. PATENT DOCUMENTS 1,010,796 A 12/1911 Pons
4,201,382 A * 5/1980 Wilson ..... A63B 5/20 482/110
4,505,474 A * 3/1985 Mattox ..... A63B 5/20 482/110
5,518,481 A * 5/1996 Darkwah ..... A63B 21/4025 482/126
5,620,397 A * 4/1997 Chieh ..... A63B 21/0004 482/121
5,643,149 A * 7/1997 Grimaldi ..... A63B 5/20 482/122
5,842,956 A * 12/1998 Strachan ..... A63B 5/20 482/81
6,540,649 B1 * 4/2003 Niedrich ..... A63B 21/0608 482/109
6,860,841 B1 * 3/2005 Mortorano ..... A63B 21/00043 482/126
7,329,212 B2 2/2008 Roque
7,344,485 B1 * 3/2008 Simpson ..... A63B 21/4009 482/121
7,503,883 B2 * 3/2009 Madden ..... A63B 21/0552 482/121

(Continued)

*Primary Examiner* — Joshua Lee
*Assistant Examiner* — Catrina A Letterman
(74) *Attorney, Agent, or Firm* — Roark IP

(57) ABSTRACT

Using a combination of jump rope, resistance band and boxing fitness instruments, one can get a robust anaerobic and aerobic exercise experience. However, traditional jump rope equipment requires the operator to be in a location that has ample height and space around them to accommodate the range of the rope being swung around the body. In addition, the ground surface that a traditional jump rope would be hitting may not always be ideal such as carpet, sand, and the like which diminishes the rhythm of the workout. The single unit multi-purpose jump fitness, boxing training and resistance strength device described herein eliminates the need for most of these restrictive considerations as there is no "rope" to jump over when in jump rope workout mode. Rather, the operator swings two specialized end handle units in a "jump rope" fashion while holding adjustable jump handles.

15 Claims, 11 Drawing Sheets

(56) References Cited

U.S. PATENT DOCUMENTS 7,621,853 B2 11/2009 LaTour
8,075,455 B2 12/2011 Gamboa
9,468,789 B2 * 10/2016 Williams ..... A63B 21/4043
2002/0103059 A1 8/2002 Kushner
2004/0009858 A1 * 1/2004 Tamaribuchi ..... A63B 21/4017 482/121
2005/0059532 A1 * 3/2005 Huang ..... A63B 21/0552 482/82
2005/0288158 A1 12/2005 LaTour
2007/0155600 A1 * 7/2007 Cunningham ..... A63B 71/023 482/121
2007/0213186 A1 * 9/2007 Longo ..... A63B 21/0552 482/121
2009/0006084 A1 3/2009 Gamboa
2010/0216608 A1 * 8/2010 Veitch ..... A63B 5/20 482/82
2011/0172067 A1 * 7/2011 Glauser ..... A63B 21/0004 482/122
2011/0224055 A1 12/2011 Kassel
2011/0306474 A1 * 12/2011 Gamboa ..... A63B 5/20 482/81
2013/0165299 A1 6/2013 Hunt
2014/0228180 A1 * 8/2014 Walker ..... A63B 21/0557 482/82
2014/0371039 A1 * 12/2014 Burrell ..... A63B 23/0233 482/124
2017/0050065 A1 * 2/2017 Carter ..... A63B 21/16
2017/0080273 A1 * 3/2017 Sanchez Gonzalez ..... A63B 23/0355
2019/0054338 A1 * 2/2019 Tang ..... A63B 21/4034
2019/0314666 A1 * 10/2019 Mantione, III .... A63B 21/1645
2020/0078628 A1 * 3/2020 Parise ..... A63B 21/0557
2021/0086015 A1 * 3/2021 Sun ..... A63B 21/0557
2021/0170219 A1 * 6/2021 Lewis ..... A63B 21/4035
2022/0134176 A1 * 5/2022 Alford ..... A63B 21/0442 482/139
2022/0280827 A1 * 9/2022 Cone ..... A63B 21/00043

* cited by examiner

MULTI-PURPOSE JUMP FITNESS, RESISTANCE STRENGTH AND BOXING TRAINING DEVICE, SYSTEM AND METHOD

TECHNICAL FIELD

The subject matter disclosed herein generally relates to athletic equipment and, in particular, a multi-purpose jump fitness, resistance strength and boxing training device.

BACKGROUND

A typical jump rope can provide for fitness through cardio, aerobic, and some anaerobic benefits. A resistance band can be used in exercise for strength training, anaerobic exercise, and limited cardio exercise. Boxing training has also provided cardio, aerobic & anaerobic benefits.

SUMMARY OF THE DISCLOSURE

Aspects of the disclosure include an exercise band apparatus, comprising: a pair of end loop handles having straps; a continuous piece elastic band having a center section coupled at each side through a pair of jump handles to a pair of end sections connected to each of the end loop handles; and wherein each of the end sections and end loop handles are capable of centripetally spinning from each of the corresponding jump handles when the apparatus is operated in a jump fitness workout mode, each of the straps of the end loop handles are capable of stretching the elastic band when the apparatus is used in a resistance band mode, and each of the jump handles are capable of stretching the elastic band with a center adjustment fastener connecting the pair of end loop handles when the apparatus is used in a boxing training mode.

Further aspects of the disclosure include an exercise band apparatus comprising: a pair of end loop handles having straps, wherein each of the straps has a length in the range of approximately 32 centimeters (cm) to approximately 47 cm and are folded over to form a first strap section and a second strap section with a distance between the first strap section and the second strap section less than approximately 5.5 cm when in jump rope workout mode and the distance between the first strap section and the second strap section greater than approximately 6 cm when in resistance band mode; an elastic band having a center section coupled at each side through a pair of jump handles to a pair of end sections connected to the end loop handles, wherein each of the end sections has a length in the range of approximately 23 centimeters (cm) to approximately 32 cm; wherein each of the end sections and end loop handles are capable of spinning centrifugally from each of the corresponding jump handles when the apparatus is operated in a jump rope workout mode; each of the straps of the end loop handles are capable of stretching the elastic band when the apparatus is used in a resistance band mode; and each of the jump handles are capable of being positioned to stretch the center section and end sections of the elastic band with a center adjustment fastener connecting the pair of end loop handles in a boxing training mode.

Further aspects of the disclosure include a method of using an exercise band apparatus for both a jump rope simulation workout, a resistance band strength workout and a boxing training workout comprising:

grasping a pair of jump handles coupled to a center section of an elastic band on a first end and a pair of end sections on the second end and causing a pair of end loop handles and the end sections to spin in a centripetal manner while in the jump rope workout; grasping straps of the end loop handles and stretching the elastic band when in the resistance band workout; and grasping the jump handles, while the apparatus is positioned for boxing training, and stretching the center section and end sections of the device for the boxing training workout.

DESCRIPTION OF THE FIGURES

Each of the figures below is provided for the purpose of illustration and description only and not as a definition of the limits of the claims. Note that the same reference items may be used in different figures and embodiments to indicate the same part and/or dimension.

DETAILED DESCRIPTION

Figure 1:
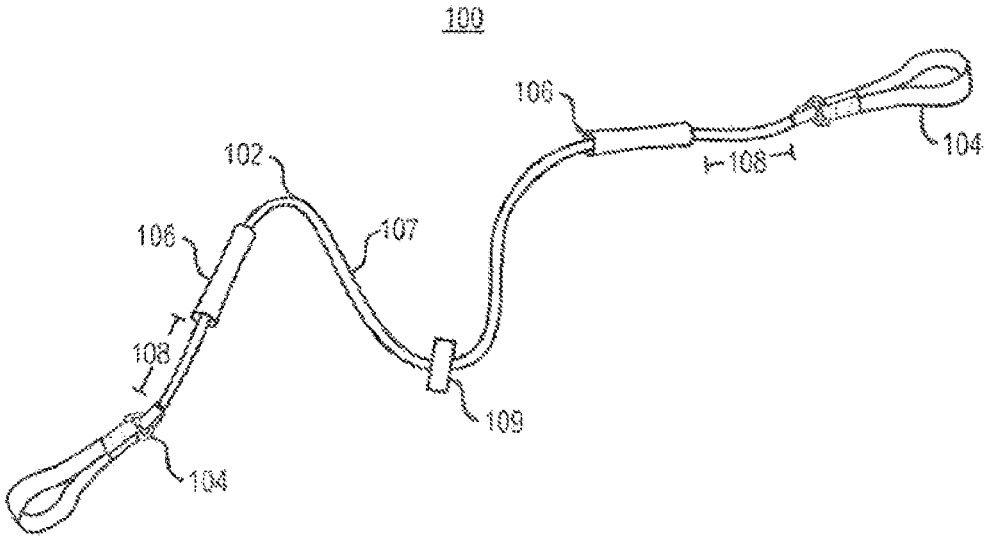
FIG. 1 illustrates an overall view of an embodiment of the multi-purpose jump fitness and resistance strength and boxing training device 100 (or just "device" as used herein).
Figure 2:
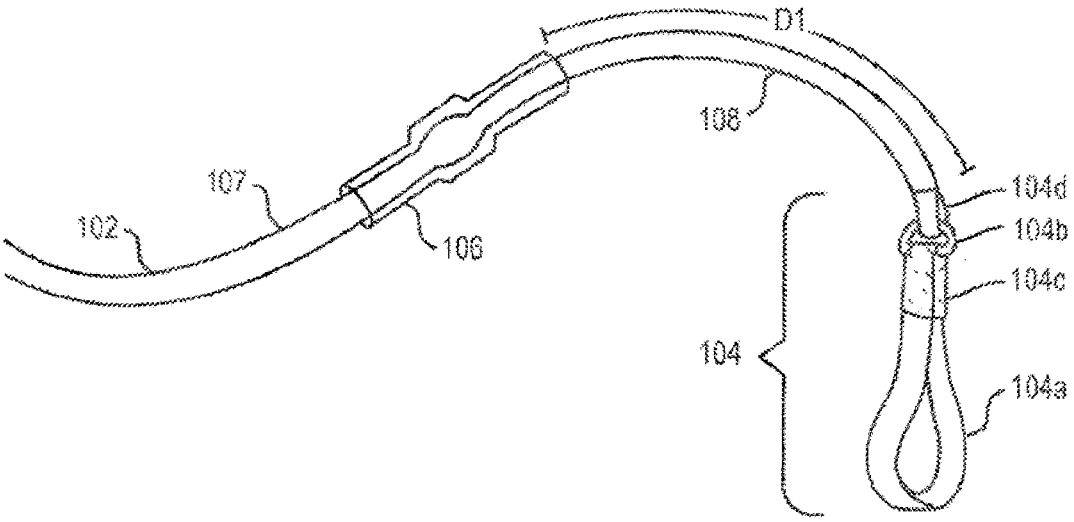
FIG. 2 is a view of a portion of the device 100.

FIG. 1 illustrates an overall view of an embodiment of the multi-purpose jump fitness, resistance strength and boxing training device 100 (or just "device" or "apparatus" as used herein). The device 100 is capable of a "jump rope" workout (or first mode of operation) a resistance band workout (or second mode of operation) and a boxing training mode (or third mode of operation) after a reconfiguration by the operator. The device 100 is one continuous piece that does not require the user to take it apart or add accessories to engage in the different configurations. FIG. 2 is a view of one end of the device 100. The multi-purpose device 100 is made up of a single length, hollow resistance cord forming a resistance band 102. The resistance band 102 will typically have an outer diameter in the range of 0.95 centimeters (cm) to 1.5 cm and overall length of approximately 260 cm. The band 102 may be made of latex rubber or comparable resistance band material. The resistance band material is capable of elongating from a non-stretched position in a range up to 300% and having a resistance force in a range of approximately 1.5 kilograms to 5 kilograms of force. The band 102 further has two specialized end loop handles 104 attached at each end and two "jump handles" 106. The area of band 102 between the jump handles 106 is the center section of the band 102. The area of the band 102 between the end loop handles 104 and jump handles 106 form "end sections" 108. Each jump handle 106 is located the length of an "end section" 108 which is a predetermined distance D1 from the end loop handles 104. During a jump fitness workout, the operator will grasp the jump handles 106 and spin the end loop handles 104 and end sections 108 while jumping up and down to simulate a jump rope workout routine. Centripetal forces and operator input maintain the end loop handles 104 and end sections 108 on a substantially circular (or substantially oval) path. Approximately in the center of the resistance band 102 there may be a center adjustment fastener 109 which allows the length of the band 102 to be shortened to accommodate the size of an operator. The center adjustment fastener 109 is capable of holding portions of band 102 together to shorten the effective length of the band 102. The center adjustment fastener 109 is also capable of connecting the end loop handles when configuring the device 100 into an embodiment for boxing workout.

In constructing a device 100 that acts not only as a resistance band and boxing trainer, but also as a jump rope simulation, the lengths, shapes and weight distribution have all been selected to provide an optimum performance of the device 100 for the user. One aspect of simulating a jump rope workout experience is calculating centripetal forces generated by the spinning end loop handles 104 and end sections 108 of band 102. The equation to calculate centripetal force is Fc=MV(2)/r where Fc=centripetal force, M=mass, V=velocity, and R=radius. A typical jump rope can average 0.90 kilograms (kg) to 1.8 (kg) of force when revolving around its axis. Upon testing various configurations in jump rope workout mode there is a certain predetermined range in which the feeling, effectiveness and average centripetal force of a traditional jump rope is achieved. Some lengths and shapes of the device 100 created inconsistent rotations and/or rotations that felt too fast. Some lengths and weights made using the device 100 more difficult and created potential for minor injury. Furthermore, ranges in lengths and weights of the device 100 were created to closely align the centripetal force of the spinning end loop handles 104 and end sections 108 of the device 100 to be in the range of approximately 0.90 kg to 1.8 kg of centripetal force when measured from the end of the jump handles 106 (i.e., the axis) to match the feeling of a typical jump rope. In dealing with how these pulling forces and swinging forces act on the Jump Handle 106, the halves are connected through hardware (screws etc.) along connector points and support bosses designed within the jump handle 106 cavity. The jump handle system can be covered with foam or rubber material for the purpose of grip and user comfort. The descriptions herein address these issues in the single unit device 100.

Figure 3A:
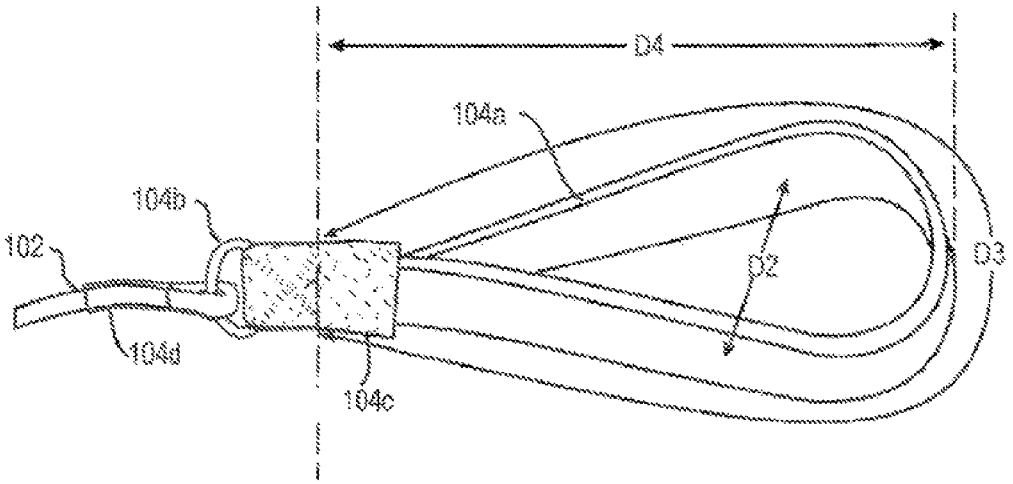
FIG. 3A illustrates a closer view of one of the end loop handles 104 of which there are two on each end of the device 100.
Figure 3B:
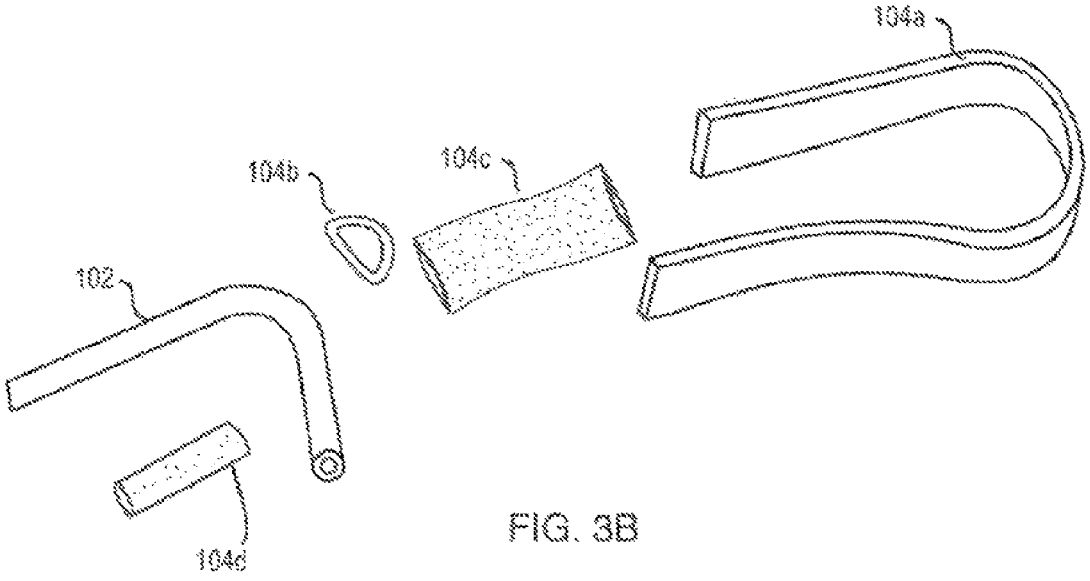
FIG. 3B shows an exploded view of one of the end loop handles 104.
Figure 3C:
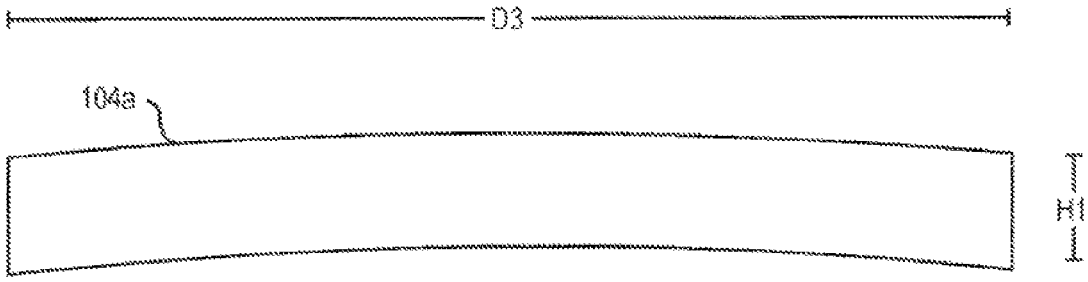
FIG. 3C shows a side view of a loop strap 104*a* for each of the end loop handles 104.
Figure 3D:
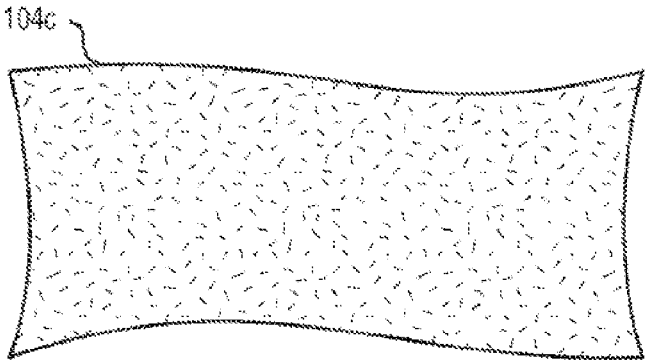
FIG. 3D shows a side view of a connection encasement 104*c*.
Figure 3E:
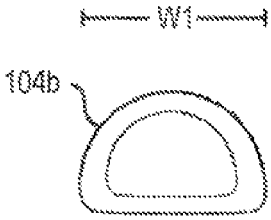
FIG. 3E is a front view of a D-ring 104*b*.
Figures 4A, 4B, 4C:
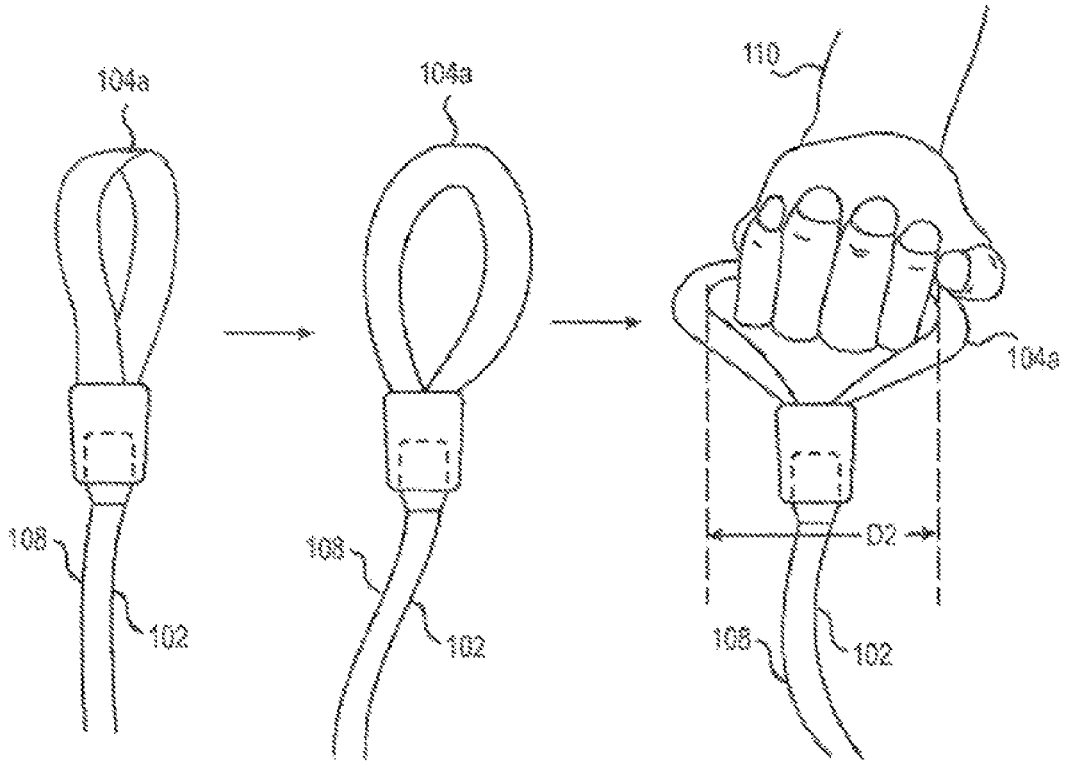
FIGS. 4A-4C shows how the end loop handles of the device 100 expand to allow different modes by the operator.

FIG. 3A illustrates a closer view of one of the end loop handles 104. FIG. 3B shows a partially exploded view of end loop handle 104. FIG. 3C shows a side view of the strap 104*a* fully elongated. FIG. 3D shows a side view of a connection encasement 104*c*. FIG. 3E is a front view of a D-ring 104*b*. The overall weight of each of the end loop handles 104 are constructed such that the end loop handles 104 serve the purpose of force and feel of a swinging jump rope for the jump rope workout but then can also be held in ways to facilitate resistance band workouts. Each end loop handle 104 is defined by a combination of the handle strap 104*a*, D-ring connection 104*b*, and connection encasement 104*c*. The handle straps 104*a* may be made of a durable fabric or rubber and have oblong loops that are capable of narrowing during a jump rope workout but also are sized to make it easy for the operator 110 to slip their hands into during the resistance band workout as shown in FIGS. 4A-4C. FIG. 4A illustrates the narrow "teardrop" appearance of the straps 104*a* in jump workout mode; the straps 104*a* getting wider as it transitions to resistance band workout in FIG. 4B; and the straps 104*a* being adjusted to fit the hand or foot size of the operator for the resistance band workout in FIG. 4C.

The handle straps 104*a* are attached to the band 102 through a connection encasement 104*c* which may be secured by stitching or an adhesive, which completes the connection as the band 102 loops through a D-ring 104*b* and is held secured by encasement 104*d* as shown in FIG. 3A. The handle straps 104*a* may have a narrow "teardrop" shape when folded with a predetermined distance D2 at their widest point during jump rope operation (although during resistance band operation this distance D2 will be greater as it conforms to the operator's hand as shown in FIG. 4C). Three considerations in the shape of the straps 104*a* when in the jump rope workout mode are drag, consistency of motion and effectiveness. When the end loop handles 104 are in motion, the more narrow, slightly elongated teardrop shape of the straps 104*a* reduces airflow drag when compared to a wider, rounder opening. This allows for a more uniform jump rope like experience. A more consistent swinging motion is also achieved with this configuration as this shape allows for a more even weight distribution of the end loop handles 104 material when in jump rope simulation mode. The configuration of the more narrow handle straps 104*a* also aids in the effectiveness of the device 100 in jump rope mode, as a wider design will sometimes impede and make contact with the user's legs when rotating thereby limiting the performance of the device 100.

In combination with the predetermined length D1 of end section 108 from the end loop handles 104 to the jump handles 106, the weight of the end loop handle 104 plays a role in the usefulness of the device in the jump rope workout mode of operation. The overall combined weight of an end loop handle 104 and end section 108 may be in the range from approximately 0.075 kg to 0.14 kg (with the end section 108 in a range of approximately 0.015 kg to 0.04 kg and end loop handle 104 in a range of 0.06 kg to 0.10 kg). In alternative embodiments, the straps 104*a* could have weighted material sewn into the straps to add more force to the jump rope workout.

Figure 3F:
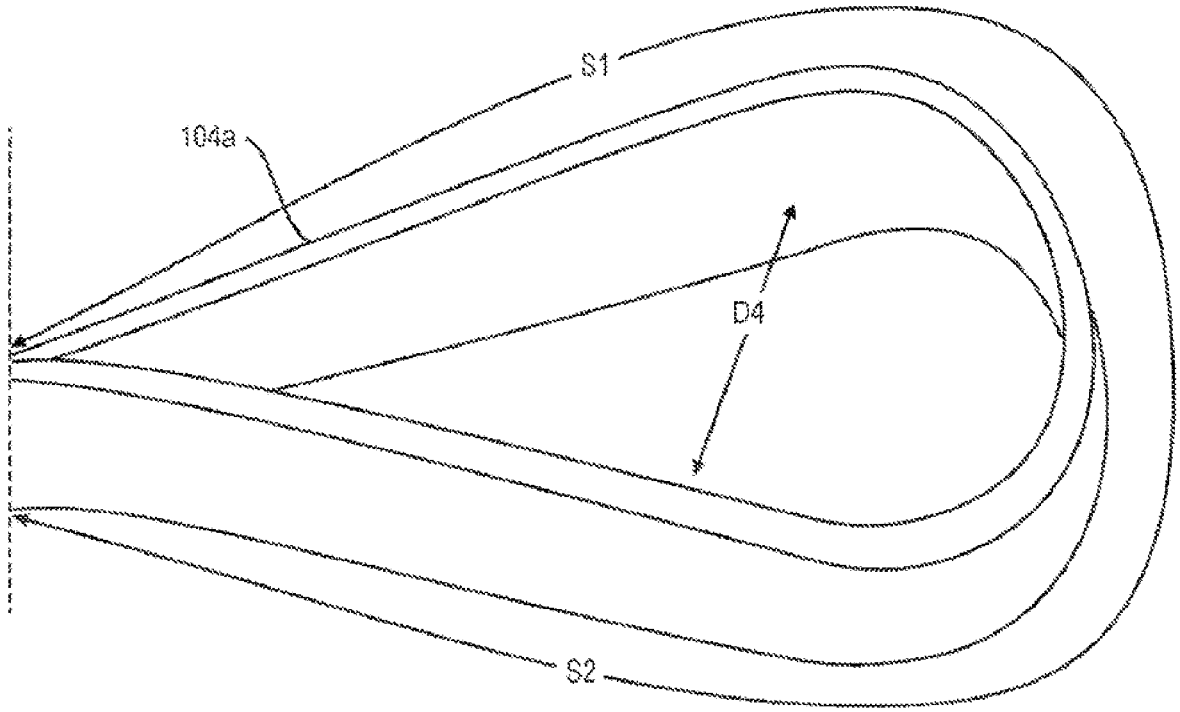
FIG. 3F is a blow up view of the tear drop section of the end loop handles 104*a*.

As shown in FIGS. 3A to 3C, the straps 104*a* of the end loop handles 104 may be made up of flexible material (e.g., rubber). The piece of material that forms each of the straps 104*a* should be in a length D3 in a range of approximately 33 centimeters (cm) to 47 cm so that when folded over it has a length of D4 in the range of approximately 16 cm to 23.5 cm. The strap 104*a* may have a height H1 of approximately 3 cm as shown in FIG. 3C. The ends of the straps 104*a* are attached together at first by securing to the connection encasement 104*c* through physical attachment, stitching, or glue. The connection encasement 104*c*, containing the end straps 104*a*, loops around and connects to the D-ring 104*b* as shown in 3A. Each of the D-rings 104*b* may have a diameter or width W1 in the range of approximately 3 cm to 4.5 cm as shown in FIG. 3E. The straps 104*a* will have an overall predetermined length of D3 as shown in FIG. 3A so that the straps 104*a* of the end loop handles 104 can be constructed in a teardrop arrangement at a second end when in jump rope workout mode. FIG. 3F shows a blow up view of the teardrop section of straps 104*a*. Each of the straps 104*a* will have a first section S1 running from where the strap ends meet to the top of the arc of the teardrop section and a second section S2 also running opposite from where the strap ends meet to the top of the arc of the teardrop section. When in jump rope workout mode, dimension D2 between the sections S1 and S2 will be in the range of approximately 1.5 cm to 5 cm. However, when used in resistance band mode, the distance D2 between first and second sections of strap 104*a* will range from approximately 6 cm to 10 cm as shown in FIG. 4C.

Figure 3G:
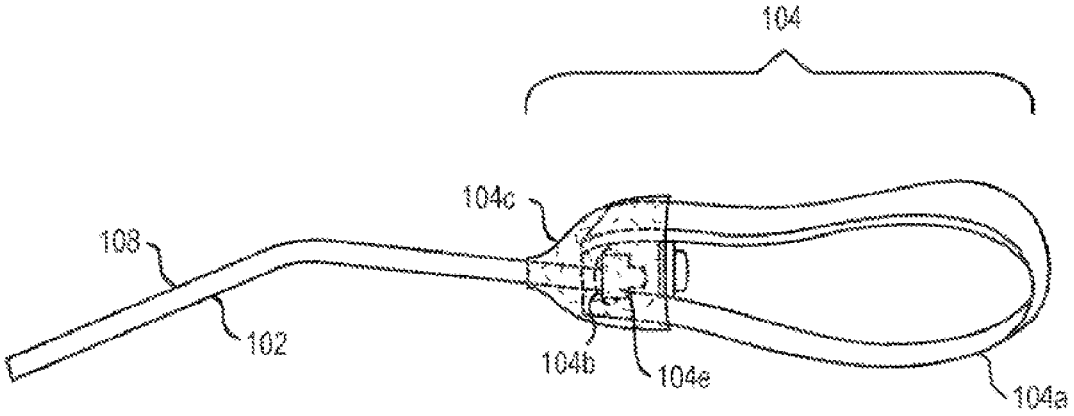
FIG. 3G illustrates a view of an alternate embodiment of the end loop handles 104 with a connection plug 104*e* attached through grommets 104*b* to hold straps 104*a*.
Figure 3H:
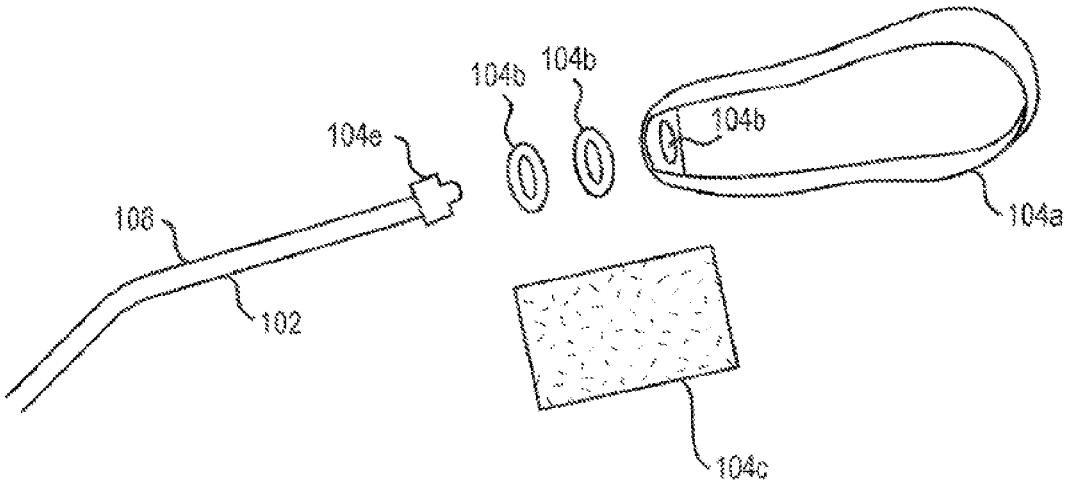
FIG. 3H shows an exploded view of the alternate embodiment.

FIG. 3G illustrates a view of an alternate embodiment of the end loop handles 104 with a plug 104*e* inserted into the end of the band 102 and attached through grommets 104*b* connected to the strap 104*a*. FIG. 3H shows an exploded view of the alternate embodiment of the end loop handles 104 of FIG. 3G.

The end section 108 length D1 as shown FIG. 2 may range between approximately 23 cm to 32 cm. At this length, when rotating in jump rope mode, the combined weight of the end section 108 and end loop handle 104 will be optimum as the centripetal force of the end sections 108 and end loop handles 104 match closely to that experienced with a traditional jump rope. A spinning end loop handle 104 plus the end section 108 may generate a centripetal force in the range of approximately 0.90 kg to 1.8 kg.

Figure 9A:
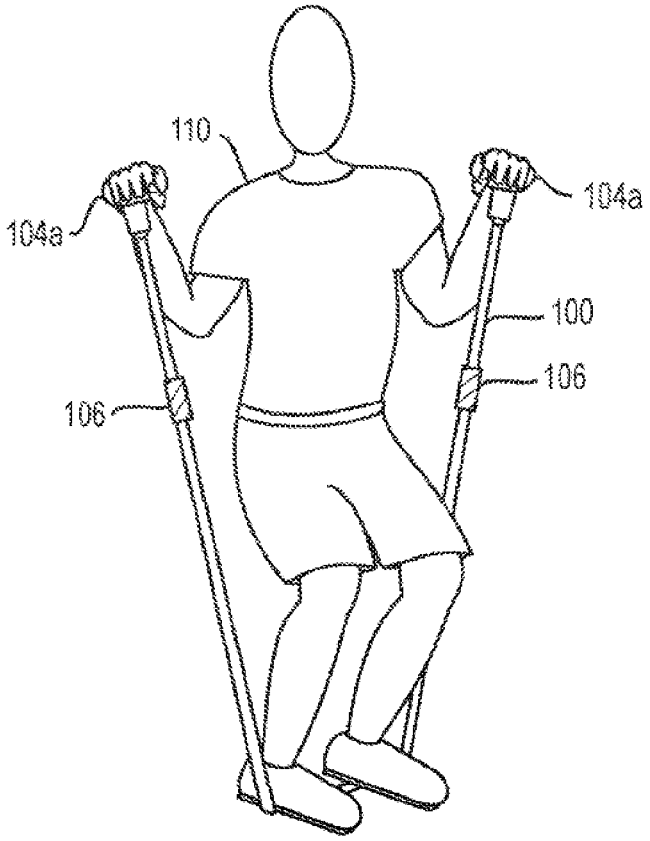
FIGS. 9A and 9B illustrate the operator 110 having moved his hands from the jump handles 106 to the loop straps 104*a* and quickly convert into, and incorporate, resistance band strength training for multiple exercises.
Figure 9B:
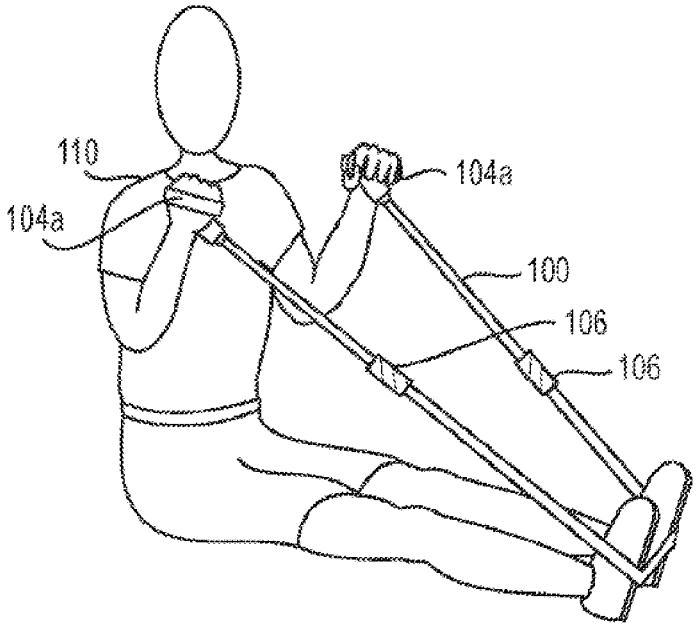
Figure 9C:
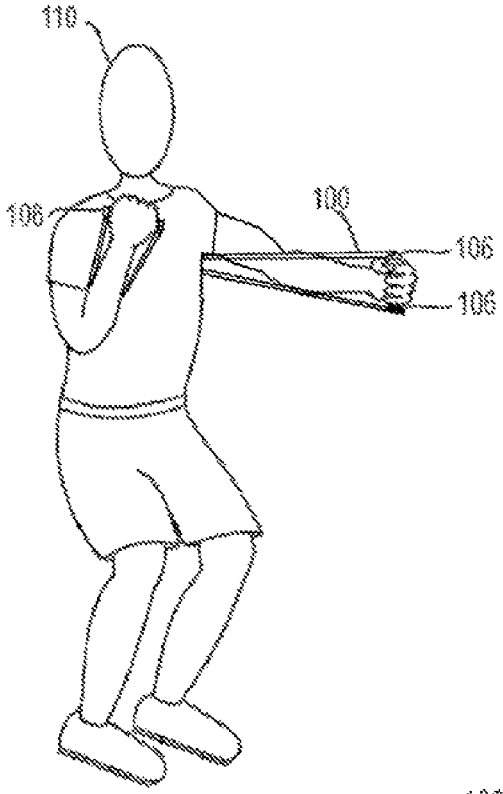
FIGS. 9C and 9D illustrate the operator 110 holding the jump handles 106 and using the device in boxing training mode.
Figure 9D:
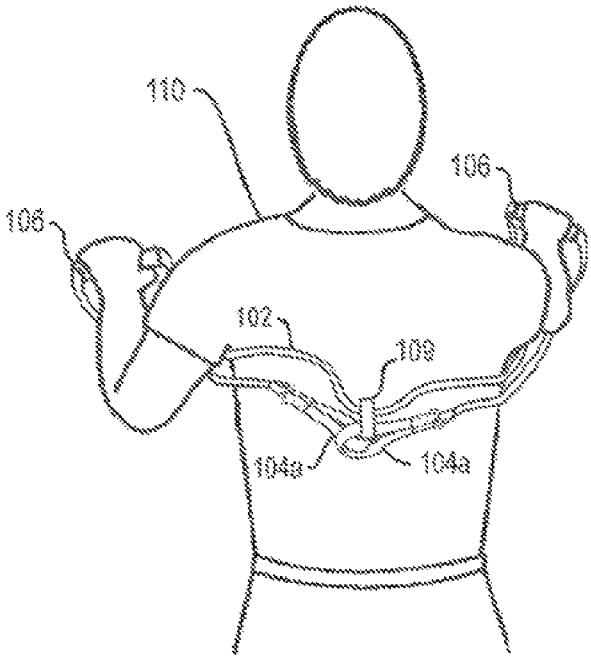

The two jump handles 106 of device 100 are affixed to, and positioned within, the outer end loop handles 104 which may be located towards the center of the band 102 at an optimal predetermined distance D1 for the operator 110 to hold and generate momentum to swing the weighted end loop handles 104 and end sections 108 during a jump rope workout. This predetermined distance D1 of the two jump handles is also optimal for when the operator 110 converts the device 100 into a boxing training configuration by connecting the center adjustment fastener 109 to the end loop handles 104 as shown in FIGS. 9C and 9D.

Figure 5:
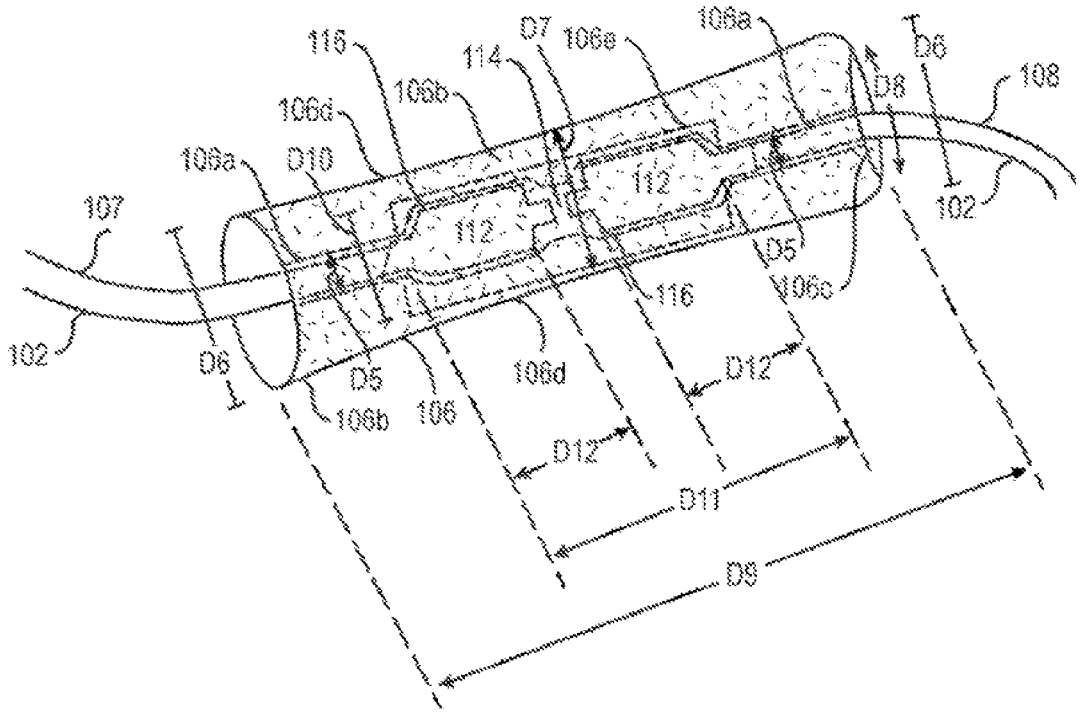
FIG. 5 shows a cross-sectional view of one of the jump handles 106, of which there are two on the device 100, grasped by the operator 110 during operation of the device.
Figure 8:
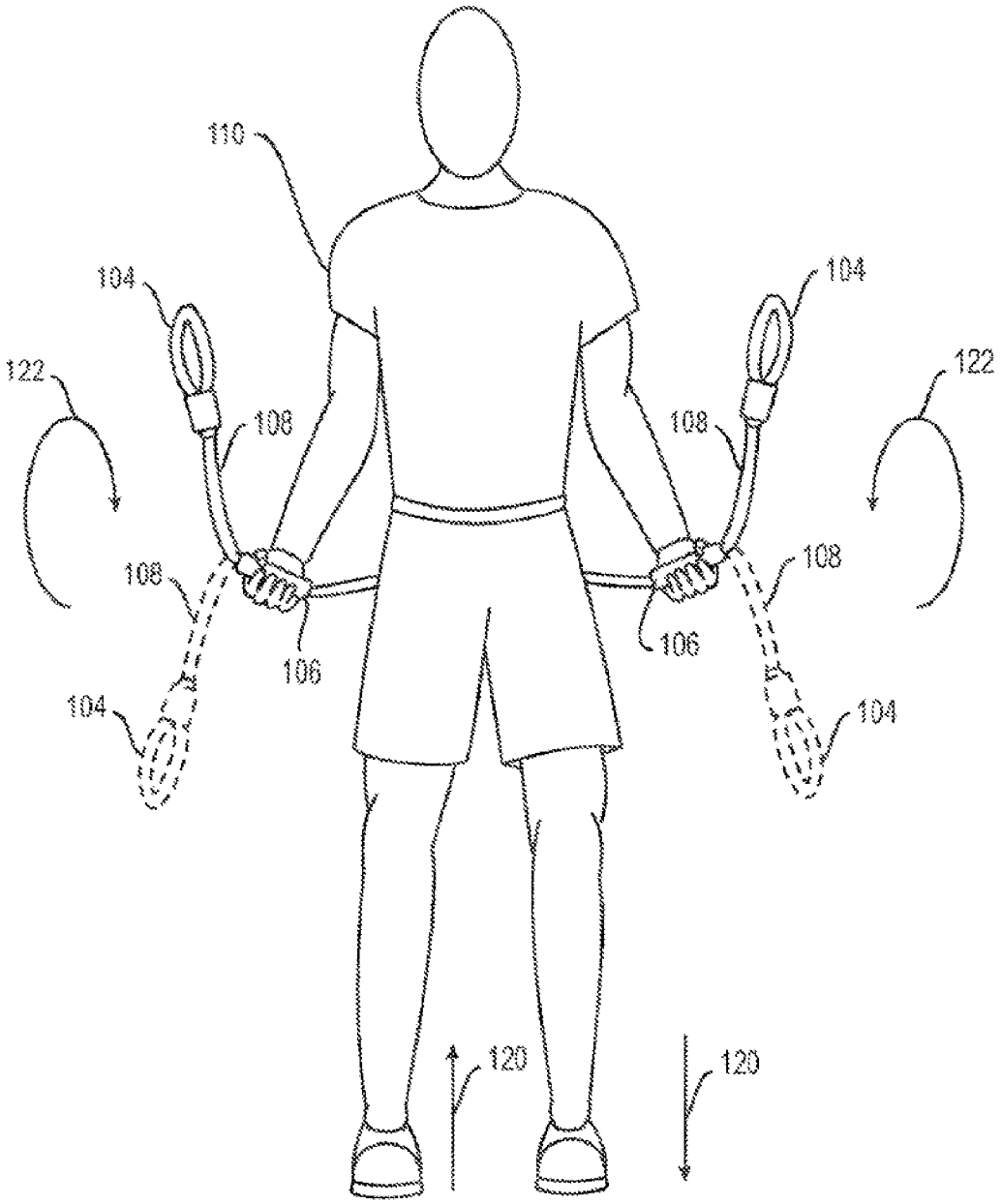
FIG. 8 illustrates the operator 110 swinging the two end loop handles 104 in a jump rope fashion while holding the jump handles 106.

FIG. 5 shows a perspective view of a first embodiment of one of the jump handles 106 held by the operator 110 during jump rope mode as shown in FIG. 8. The construction of both jump handles 106 will be the same. The band 102 enters a first end of the jump handle 106 from the center section 107 side. A tube 106*a* is formed by two lengthwise jump handle parts 106*b* coming together in a mechanical attachment such as guide and support bosses with connection of hardware or glue. The tube 106*a* has a diameter D5 which may range from approximately 1 cm to 1.25 cm. The jump handle may have a diameter D6 that may be in the range of approximately 2.75 cm to 3.25 cm at its widest points and a diameter of D7 that may be in the range of approximately 2 cm to 2.5 cm near the center of the jump handle 106 where the operator 110 grips during the jump rope workout and boxing training. The end of jump handle 106 facing the end section 108 may have an inner curvature (or depression) 106*c* having a center angle D8 in the range of approximately 75 to 125 degrees with rounded edges at the circumference to allow the end section 108 to rotate optimally with less friction. Jump handle parts 106*b* may have a textured surface 106*d* to allow for a better grip by the operator 110 during the jump rope workout mode. The length D9 of jump handle 106 may range from approximately 11 cm to 14 cm. Internal cavity 106*e* may have a width D10 in the range of approximately 1.5 to 2 cm and a length D11 in the range of approximately 3.75 to 4.25 cm. Two internal plugs 112 may be inserted into (e.g., blown into) bands 102 with each plug 112 having a diameter D12 with a length in the range of approximately 1.75 to 2 cm. The plugs 112 may either be in contact or separated by a space at point 114. A thin rubber membrane 116 may encase both plugs 112 in cavity 106*e*. Constructing the interior of the jump handles 106 in this manner allows for an anchor point where the jump handle 106 can attach thereto. When the band 102 is stretched the excessive thinning of the diameter of the band 102 may make it difficult to attach a jump handle 106 as it may have unwanted movement or shifting. The disclosed jump handle configuration resolves that issue. By using two plugs 112, it will be easier to insert each of the plugs 112 into the bands 106 during manufacturing of the device 100 than previous manufacturing methods.

Figure 6:
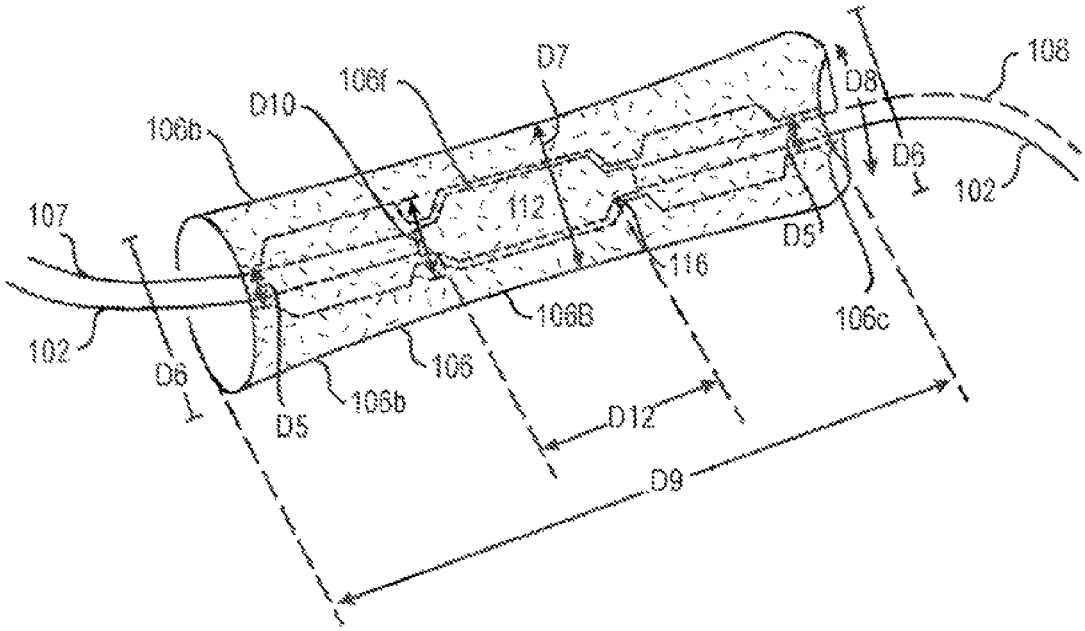
FIG. 6 shows a cross-sectional views of an alternative embodiment of the jump handle 106 grasped by the operator 110 during operation of the device.

FIG. 6 shows a second embodiment of the jump handles 106. In this embodiment, the jump handle 106 has only one plug 112 inside the band 102 so the internal cavity 106*f* will be approximately half the length of internal cavity 106*e* shown in FIG. 5. The internal cavity 106*f* may therefore have a reduced length in the range of approximately 1.75 cm to 2.25 cm but have the same width D10 as that of cavity 106*e*. Constructing the interior of the jump handles 106 in this manner also allows for an anchor point where the jump handle 106 can attach thereto as discussed above. Where only one plug 112 is used there may be less movement of jump handles 106 relative to band 102 when stretching the device 100. The tension may also be more evenly distributed throughout the band 102 in this embodiment. There is also a benefit in manufacturing by having to encase only one plug 112 instead of two as shown in the embodiment of FIG. 5.

Figure 7A:
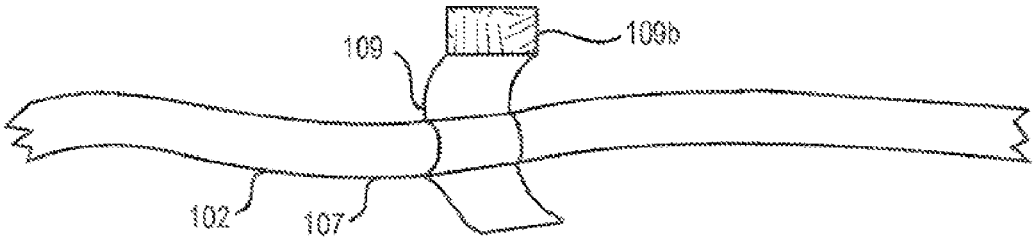
FIGS. 7A-7C are views of the center adjustment fastener 109 located on the band 102 of device 100.
Figure 7B:
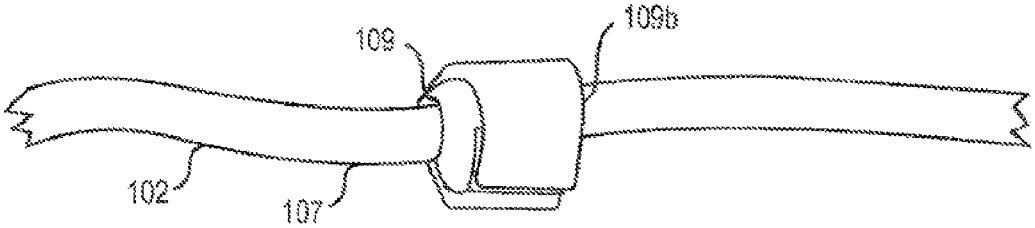
Figure 7C:
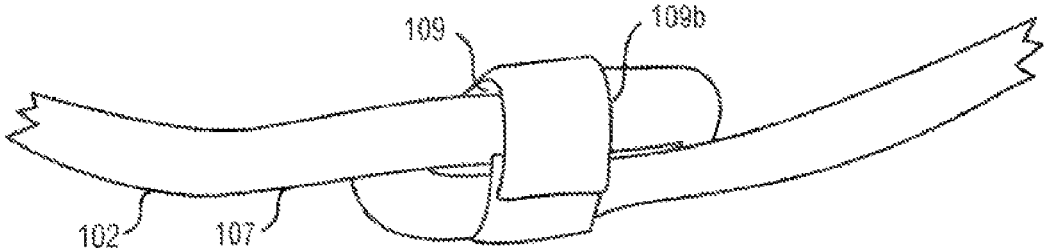

FIGS. 7A-7C shows the center adjustment fastener 109 on the center section 107 of band 102. The length of the device 100 from first end loop handle 104 to second end loop handle 104 is a constant so the operator of device 100 may utilize the center adjustment fastener 109 to shorten the distance between jump handles 106 when in jump rope workout mode. By shortening the band 102 of the device 100 in the approximate center, there will be less slack around the back of the operator 110 and the operator 110 may feel more comfortable when engaged in jump rope workout mode. To utilize the center adjustment fastener 109, the operator 110 loops a portion of the band 102 of the device 100 and closes belt 109*b* around it tight, thus taking up the appropriate amount of slack. Belt 109*b* may have an adhesive portion to allow closure such as Velcro®.

When in jump rope mode, the end loop handles 104 and end sections 108 of band 102 act as weighted entities to allow for circular "jump rope like" motion when spun in a circular fashion. When in resistance band training mode, the loops 104*a* of the handles 104 expand enough for an operator 110 to put their hand (or foot) into, allowing them to pull or push the band 102 as shown in FIG. 4C. As discussed above, the end loop handles 104 are weighted in such a way that the centripetal force will give the operator 110 a sense of the jump rope feel. The device 100 in operation provides a sense of a traditional rope flowing over and under the operator 110 while jumping up and down as indicated by arrows 120 in FIG. 8. While the end sections 108 and end loop handles 104 are going in a circular motion, simulating the jump rope feel, the part of the band 102 that is behind the operator's back is substantially slack and is not engaged in any function other than a serving as a connection from one side of the device 100 to the other. When the centripetal force is applied to the end loop handles 104, this configuration allows for more consistent movement of the end loop handles 104 in their circular path around the axis of jump handles 106. A more even and consistent feel to the "jump rope" function is achieved.

FIG. 8 shows the device 100 in a jump rope workout mode. FIGS. 9A-9B show how the device 100 is used in resistance band workout mode and FIGS. 9C-9D show how the device 100 is used in a boxing training mode. Using jump rope workout mode, resistance band mode and boxing training mode the operator 110 can get a robust anaerobic and aerobic exercise experience. Traditional jump rope training equipment requires the operator 110 to be in a location that has ample height and space around them to accommodate the range of the rope being swung around the body. The ground surface that the jump rope would be hitting may not always be ideal such as carpet, sand, or the like which diminishes the rhythm of the workout. The device 100 may be used as an alternative to a traditional jump rope, but without the rope swinging over or around the body of the operator. The embodiments of the device 100 described herein eliminate the need for most of these restrictive considerations as there is no rope that the operator needs to jump over.

As shown in FIGS. 9A-9B, device 100 converts from a jump rope workout to be used in resistance workout by the operator 110. By letting go of where the operator 110 was holding the jump handles 106 and putting their hands (or feet) through the straps 104*a* of end loop handles 104, the operator 110 can engage in many different resistant band strength training exercises. The operator 110 can put the center of the resistance band 102 under one or both of their feet. In this position the operator 110 can engage in arm/shoulder/back resistance exercises by pulling up and lowering down their hands and arms while feeling the resistance. Alternatively, the band 102 can be placed around a stable object such as a pole, doorknob, or the like and the operator 110 can engage in arm/shoulder/back resistance exercises pulling up and lowering down their hands and arms and feeling the resistance. In FIG. 9B, the operator 110 can engage in arm/shoulder/back resistance exercises by holding the straps 104*a* of the end loop handles 104 and pulling up and down while feeling the resistance.

Referring to FIG. 8, the operator 110 can position and hold the device 100 in such a way as to use it in a jump rope workout manner. By taking ahold of each of the jump handles 106 with a left hand on one jump handle 106 and a right hand on the other jump handle 106, the operator 110 puts the band behind their back. The end loop handles 104 and end sections 108 of band 102 dangle down from where the operator 110 is holding the jump handles 106. With arms poised to start a traditional jump rope motion, the operator 110 starts to swing both end loop handles 104 circularly forward (or backward) and end sections 108 as shown by arrows 122 and broken lines in a unison motion while jumping in place as shown by arrows 120. The motion would be as if the operator 110 is swinging a traditional jump rope over their head. In reality, the operator 110 is swinging in a circular manner the end sections 108 and end loop handles 104 while jumping up and down.

As shown in FIGS. 9C and 9D the operator can enable the device 100 to be used in a third configuration for boxing training. The operator 110 can bring the two end loop handles 104 together and secure the center adjustment fastener 109 through and around one or both of the straps 104*a* thereby converting the device 100 into a configuration that forms a substantially "figure 8" loop. By connecting the center adjustment fastener 109 to the straps 104*a* of the end loop handles 104 in this way, the operator 110 can now position the device 100 around their back and then take ahold of the jump handles 106 in each hand to engage in boxing training which promotes form and strength.

Benefits of the embodiments of the device 100 disclosed herein may include the following. First, the device 100 can be used for a jump rope simulated workout. The device 100 has a set of end loop handles 104 which allow it to be used in a jump rope simulation mode giving the user a feeling of a traditional jump rope workout. Second, the device 100 allows for aerobic exercise and cardio training and anaerobic exercise. Third, the device 100 may be used as a resistance band strength workout. Fourth, the device 100 may be converted to and used as a boxing trainer. Fifth, the device 100 is one continuous piece (or a single unit), easily allowing the operator to switch between resistance band, jump rope simulation and boxing training modes without needing to take the device 100 apart or require extra accessories. Sixth, the configuration allows for jump rope simulated workout in tighter spaces and surroundings where a typical jump rope would not allow. The device 100 does not need the jump rope to go over or under the operator, therefore the operator does not have to worry about a traditional jump rope hitting the operator's feet which can interrupt the workout. Seventh, the device 100 may have a predetermined length longer than typical resistance bands which allows for more options in creating exercises. For example, there may be length enough to stand on the device 100 and still grab jump handles 106 for resistance band exercises. Eighth, the end loop handles 104 are weighted and designed to give a sense of using a typical jump rope. Ninth, the device 100 is easy to use in both resistance band operation, jump rope simulation and boxing training. Tenth, the end loop handles 104 are more narrow with the straps 104*a* closer together when use as a jump rope simulation, but the straps 104*a* are capable of being more open for an operator's hand or foot when the operator wants to use the device 100 as a resistance band. Eleventh, the device 100 may have a center adjustment fastener 109 which allows an operator to change the overall length of the band 102 for a more comfortable fit when using in a jump rope workout mode and allows the device to convert to a boxing training configuration. Twelfth, the device 100 is a single flexible unit and can be stored easily.

The methods, systems, and devices discussed above are examples. Specific details are given in the description to provide a thorough understanding of the embodiments. However, embodiments may be practiced without these specific details. For example, well-known processes, structures, and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention. Also, features described with respect to certain embodiments may be combined in various other embodiments. Different aspects and elements of the embodiments may be combined in a similar manner. Also, technology evolves and, thus, many of the elements are examples that do not limit the scope of the disclosure to those specific examples.

Also, some embodiments were described as processes. Although these processes may describe the operations as a sequential process, many of the operations can be performed in parallel or concurrently. In addition, the order of the operations may be rearranged. A process may have additional steps not included in the figures. Also, a number of steps may be undertaken before, during, or after the above elements are considered.

Having described several embodiments, various modifications, alternative constructions, and equivalents may be used without departing from the spirit of the disclosure. For example, the above elements may merely be a component of a larger system, wherein other rules may take precedence over or otherwise modify the application of the invention. Accordingly, the above description does not limit the scope of the disclosure.

The term "approximately" as used herein shall mean within 2% of the designated value.

It should be noted that the recitation of ranges of values in this disclosure are merely intended to serve as a shorthand method of referring individually to each separate value falling within the range, unless otherwise indicated herein, and each separate value is incorporated into the specification as if it were individually recited herein. Therefore, any given numerical range shall include whole and fractions of numbers within the range. For example, the range "1 to 10" shall be interpreted to specifically include whole numbers between 1 and 10 (e.g., 1, 2, 3, . . . 9) and non-whole numbers (e.g., 1.1, 1.2, . . . 1.9).

The invention claimed is:

1. A method of using an exercise band apparatus for both a jump rope simulation workout, a resistance band strength workout and a boxing training workout comprising:

grasping a pair of jump handles coupled to a center section of an elastic band on a first end and a pair of end sections on a second end and causing a pair of end loop handles and the pair of end sections to spin in a centripetal manner while in the jump rope workout;

grasping straps of the pair of end loop handles and stretching the elastic band when in the resistance band workout; and grasping the pair of jump handles, while the apparatus is positioned for boxing training, and stretching the center section and the pair of end sections of the device for the boxing training workout.

2. The method of claim 1, further comprising:

bringing the pair of end loop handles together and securing a center adjustment fastener through and around at least one of the straps of the end loop handles to convert the apparatus into a configuration that forms a figure 8 loop for the boxing training workout.

3. The method of claim 2, wherein the figure 8 loop is positioned around a back of a user.

4. The method of claim 1, further comprising:

positioning part of the elastic band to be behind the user's back and slack while in the jump rope workout.

5. The method of claim 1, wherein each end loop handle of the pair of end loop handles are connected to the elastic band through a D-ring attachment.

6. The method of claim 1, wherein each end loop handle of the pair of end loop handles are connected to the elastic band through a grommet to plug attachment.

7. The method of claim 1, wherein each end section of the pair of end sections has a length in the range of approximately 23 centimeters (cm) to approximately 32 cm.

8. The method of claim 1, wherein each of the straps of the pair of end loop handles has a length in the range of approximately 32 centimeters (cm) to approximately 47 cm.

9. The method of claim 1, wherein the weight of each end section of the pair of end sections is in a range of approximately 0.015 kilograms (kg) to approximately 0.04 kg and each end loop handle of the pair of end loop handles are in a range of approximately 0.06 kg to approximately 0.10 kg.

10. The method of claim 1, further comprising:

shortening the length of the center section by fastening two portions of the center section together between an adhesive belt.

11. The method of claim 1, further comprising:

connecting the pair of end loop handles and center section together between an adhesive belt.

12. The method of claim 1, further comprising:

at least one plug inserted into each end of the center section of the elastic band and enclosed by a respective jump handle of the pair of jump handles.

13. The method of claim 12, further comprising:

a second plug inserted into an end of each end section of the pair of end sections and enclosed in a respective jump handle of the pair of jump handles.

14. The method of claim 1, wherein the pair of jump handles are formed with lengthwise jump handle parts that come together to enclose a plugged end of the center section and a plugged end of a respective end section of the pair of end sections.

15. The method of claim 1, wherein each of the jump handles has a length in the range of approximately 11 centimeters (cm) to approximately 14 cm.

* * * * *